US009174106B1

(12) United States Patent
Spivey

(10) Patent No.: US 9,174,106 B1
(45) Date of Patent: Nov. 3, 2015

(54) TAPE AND METHODS OF ATTACHING TAPE TO A HEAD OF A LACROSSE STICK

(71) Applicant: Britton Paige Spivey, Cary, NC (US)

(72) Inventor: Britton Paige Spivey, Cary, NC (US)

( * ) Notice: Subject to any disclaimer, the term of this patent is extended or adjusted under 35 U.S.C. 154(b) by 125 days.

(21) Appl. No.: 14/031,985

(22) Filed: Sep. 19, 2013

(51) Int. Cl.
*B29C 65/00* (2006.01)
*A63B 59/02* (2006.01)

(52) U.S. Cl.
CPC ..... *A63B 59/02* (2013.01)

(58) Field of Classification Search
CPC ..... A63B 59/02; A63B 2243/005; A63B 59/0092; A63B 59/025
USPC ..... 156/157, 227, 223, 196, 204, 200; 473/513, 510, 505
See application file for complete search history.

(56) References Cited

U.S. PATENT DOCUMENTS

| | | | | |
|---|---|---|---|---|
| 4,192,506 | A | 3/1980 | Sofia | |
| 7,521,013 | B2 | 4/2009 | Tucker, Sr. | |
| 2004/0072637 | A1* | 4/2004 | Morrow et al. | 473/513 |
| 2008/0248899 | A1 | 10/2008 | Whitten et al. | |
| 2009/0170626 | A1* | 7/2009 | Chen et al. | 473/301 |
| 2013/0160921 | A1* | 6/2013 | DiCasmirro | 156/60 |

FOREIGN PATENT DOCUMENTS

EP 2368604 A1 9/2011

OTHER PUBLICATIONS

McCulloch, P., et al., "Injuries in Men's Lacrosse." Orthopedics, vol. 30, No. 1, Jan. 2007. Accessed online Sep. 16. 2013 at http://www.healio.com/orthopedics/journals/ortho/%7B589216dd-bc64-4749-8aed-d22ccf9089a0%7D/injuries-in-mens-lacrosse.

* cited by examiner

*Primary Examiner* — Jacob T Minskey
*Assistant Examiner* — Vishal I Patel
(74) *Attorney, Agent, or Firm* — Coats & Bennett, P.L.L.C.

(57) ABSTRACT

Methods of attaching a tape to a head of a lacrosse stick. The tape includes a first side that is attached to the head, and an opposing second side with a number of different sections each with different frictional coefficient values. A first section may include a low friction coefficient value and is configured to be positioned along an outer edge of the head to facilitate sliding the head along the ground. A second section includes a higher coefficient value and is configured to be positioned along an inner side of the head to contact against the lacrosse ball to facilitate ball control. The tape is configured to be used with a lacrosse stick, but may also be used in various other contexts.

19 Claims, 5 Drawing Sheets

TAPE AND METHODS OF ATTACHING TAPE TO A HEAD OF A LACROSSE STICK

BACKGROUND

The present application is directed to an elongated tape having different frictional coefficient values along different sections of the width that is applicable for use with a head of a lacrosse stick and methods of attaching the tape to a head of a lacrosse stick.

Lacrosse is a sport that is quickly growing in popularity. Each player on a lacrosse team uses a stick to pass and catch a ball. The stick includes an elongated shaft with a head at one end. The head includes a frame that forms an opening. A net is attached to the head and extends across the opening to form a pocket for catching and passing the ball.

During a game, a player is often required to use their stick to scoop up a ball on the ground. This includes the user holding the shaft in their hands and positioning the head under the ball and scooping it into the pocket. This action often includes the head sliding along the ground immediately before the ball is scooped into the pocket and while the player is running along the field.

Because of the characteristics of the lacrosse stick and the movement of the player, the head of the stick has a tendency to dig into the field instead of sliding along as the user attempts to scoop the ball. This digging action may result in the player suddenly coming to a stop and possibly being injured. Additionally, the often results in the user failing to scoop the ball into the pocket.

Therefore, there is a need for configuring the head of the lacrosse stick to reduce or eliminate the digging action of the stick when a user is attempting to scoop the ball from the field.

SUMMARY

The present application is directed to a tape with different friction coefficient values and methods of attaching the tape to the head of a lacrosse stick.

One embodiment is directed to a method of preparing a lacrosse stick that includes aligning an elongated tape along a beam of a head of the lacrosse stick with the tape including a length measured between first and second ends and a width measured between opposing first and second sides. The method includes aligning a first width section that extends inward from the first side of the tape along an outer side of the beam, and aligning a second width section of the tape that extends inward from a second side of the tape along an inner side of the beam. The method includes attaching the tape to the beam. The first and second width sections extend in a non-overlapping arrangement across the width of the tape and along the length of the tape. The first width section includes a lower friction coefficient value than the second longitudinal section and the outer side of the beam.

The method may also include unwinding the tape from a roll and removing the tape from the roll prior to attaching the tape to the beam.

The method may also include removing the tape from a backing on an enlarged sheet prior to attaching the tape to the beam.

The method may also include contacting an adhesive on an underside of the tape against the beam and attaching the tape to the beam.

The method may also include aligning indicia that extends along the length of the tape along an edge of the beam with the edge of the beam positioned between the inner and outer sides of the beam.

The indicia may include a visible line positioned at an intersection of the first and second width sections of the tape.

The method may also include preventing the second width section of the tape from being positioned on the outer side of the beam.

The method may also include positioning the first width section across an edge of the beam between the inner and outer sides and along a portion of the inner side.

Another embodiment is directed to a method of preparing a lacrosse stick that includes attaching an elongated tape to a beam of a head of a lacrosse stick. The tape includes a first section along a first portion of the width that has a lower friction coefficient and a second section along a second portion of the width that has a higher friction coefficient. The first and second sections extend along a length of the tape. The first section of the tape is attached over an outer side of the head of the lacrosse stick, and the second section of the tape is attached over just an inner side of the head of the lacrosse stick without extending over the outer side.

The first and second sections may be in a non-overlapping arrangement across the width of the tape.

The first width section may include a lower friction coefficient value than the outer side of the beam.

The method may also include aligning an elongated indicia that extends along the length of the tape with an edge of the head formed between the inner and outer sides.

The method may also include unwinding the tape from a roll and removing the tape from the roll prior to attaching the tape to the beam.

The method may also include contacting an adhesive on an underside of the tape against the beam and attaching the tape to the beam.

The method may also include positioning the first section across an edge of the beam between the inner and outer sides and along a portion of the inner side.

The method may also include positioned a greater portion of the width of the tape along the outer side of the beam than along the inner side of the beam.

Another embodiment is directed to a method of preparing a lacrosse stick with the lacrosse stick including a frame that includes a beam and opposing sidewalls that form at least a portion of a pocket. The method includes aligning a tape with the beam with the tape having an outer side and an inner side and a width measured between opposing first and second lateral sides. The outer side has a first portion of the width that extends inward from the first lateral side having a lower coefficient value than an outer side of the beam and a second portion of the width that extends inward from the second lateral side of the tape having a higher coefficient value than the first portion. The method includes contacting the inner side of the tape against the beam and attaching the tape to the beam with the first portion exposed along the outer side of the beam and the second portion exposed along an inner side of the beam. The method includes the first and second portions extending in a non-overlapping arrangement across the width of the tape.

The first portion may include a greater width than the second portion.

The method may also include aligning indicia that extends along the length of the tape at an intersection of the first and second portions.

The method may include attaching the first portion of the tape over an edge of the beam formed between the inner and outer sides of the beam.

The various aspects of the various embodiments may be used alone or in any combination, as is desired.

DETAILED DESCRIPTION

The present application is directed to methods of attaching a frictional tape to a head of a lacrosse stick. The tape includes a first side configured to be attached to the head, and an opposing second side with a number of different sections each with different frictional coefficient values. A first section may include a low friction coefficient value and is configured to be positioned along an outer edge of the head to facilitate sliding the head along the ground during use. A second section of the tape includes a higher coefficient value and is configured to be positioned along an inner side of the head to contact against the lacrosse ball to facilitate ball control. The tape is configured to be used with a lacrosse stick, but may also be used in various other contexts.

Figure 1:
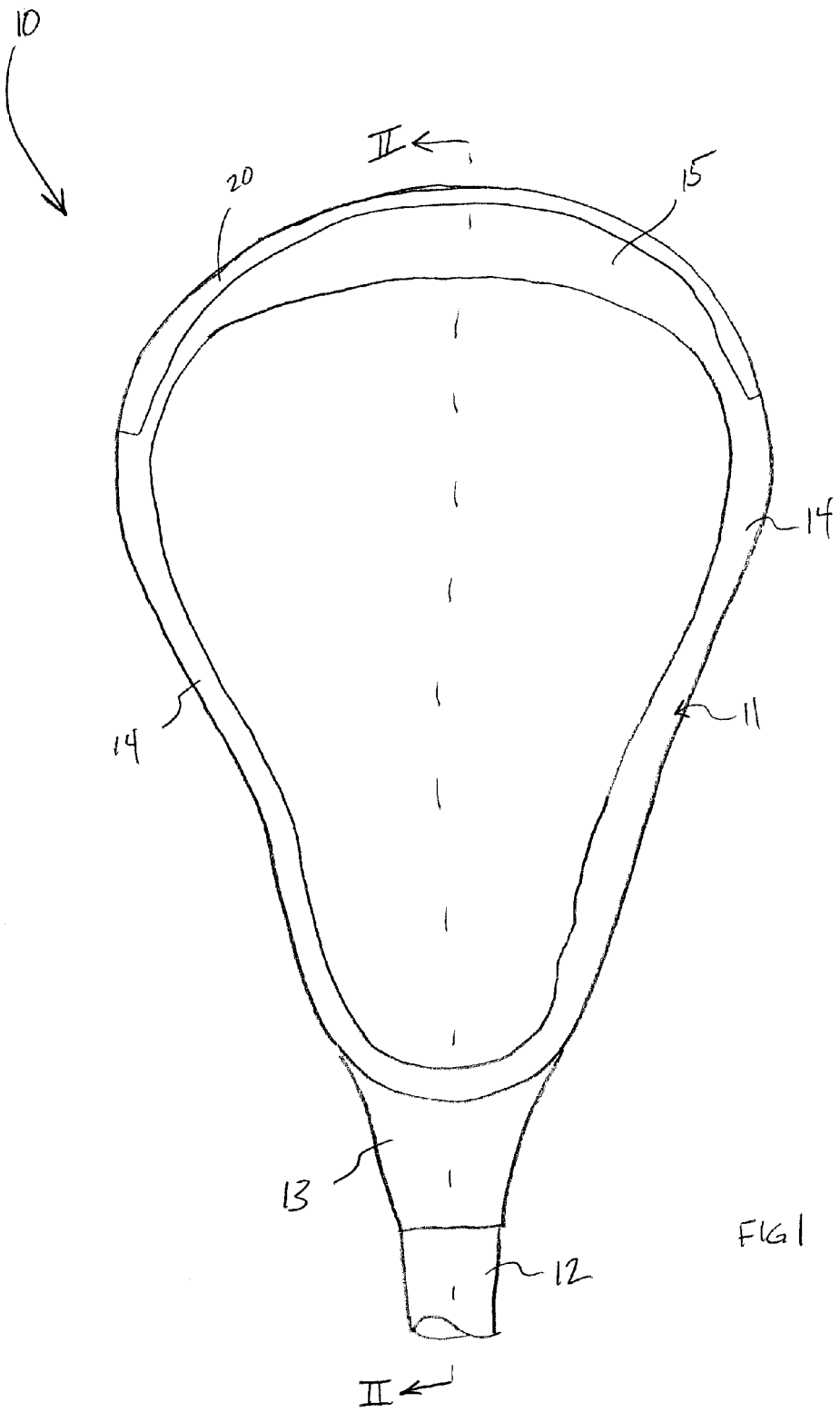
FIG. 1 is a front view of a head of a lacrosse stick with tape attached along a beam of the head.
Figure 2:
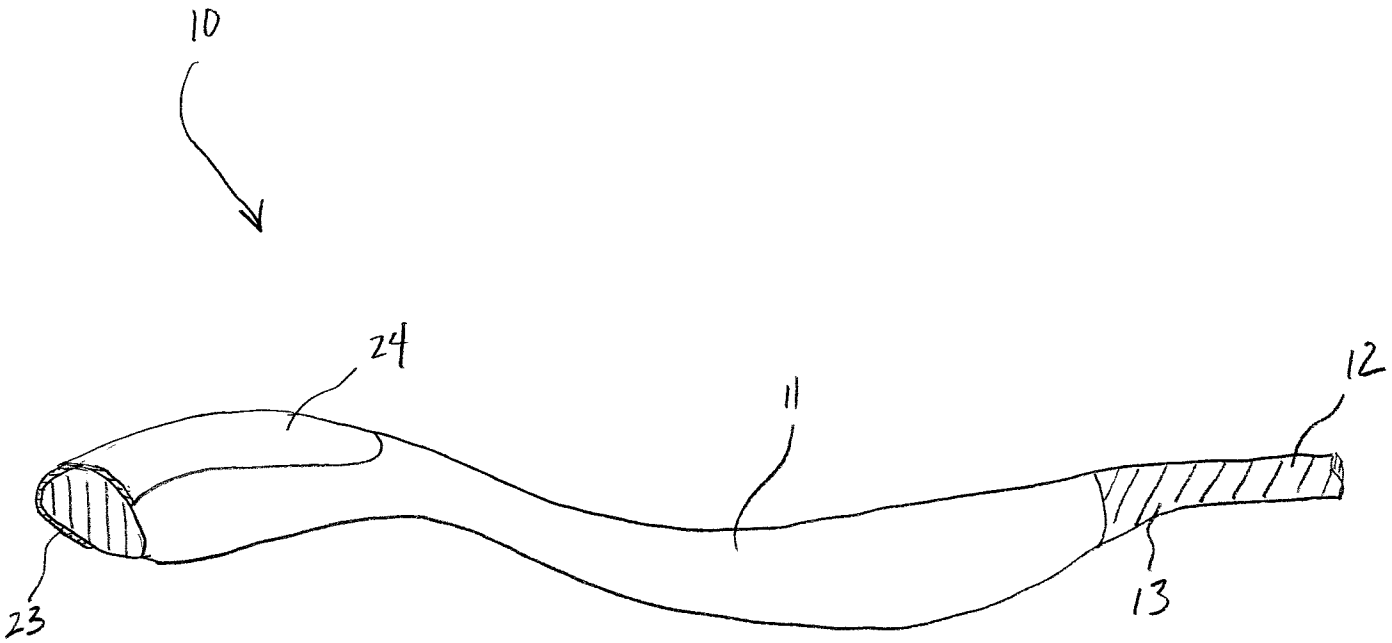
FIG. 2 is a sectional view of the lacrosse stick and tape cut along line 11-11 of FIG. 1.

FIGS. 1 and 2 illustrate a lacrosse stick 10 with a tape 20 that extends across an upper section of the head 11. The tape 20 is attached with a first section 23 of the exposed side positioned along an outer side of the head 11, and an opposing second section 24 positioned along an inner side of the head 11. The first section 23 includes a low friction coefficient value to facilitate sliding of the head 11 along the ground during use, such as when attempting to scoop a ball from the field. The second section 24 includes a higher friction coefficient value to facilitate contact with the ball. This higher value may facilitate placing a spin on the ball when thrown from the pocket.

The lacrosse stick 10 includes the head 11 mounted at an end of a shaft 12. The head 11 includes a neck 13 along a proximal portion, a beam 15 along a distal portion, and a pair of opposing sidewalls 14. An opening is formed within an interior of the head 11. A net attached to the head 11 and extends across the opening forming a pocket to hold the ball. For purposes of clarity, the net is not included in the drawings. The head 11 may include various shapes, sizes, and stiffness' depending upon the needs and preferences of the user. Examples of different heads 11 include but are not limited to an offset head, cant head, and onset head. Further, the head 11 and shaft 12 may be constructed from a variety of materials, including but not limited to aluminum, titanium, carbon fiber, and plastic.

Figure 3:
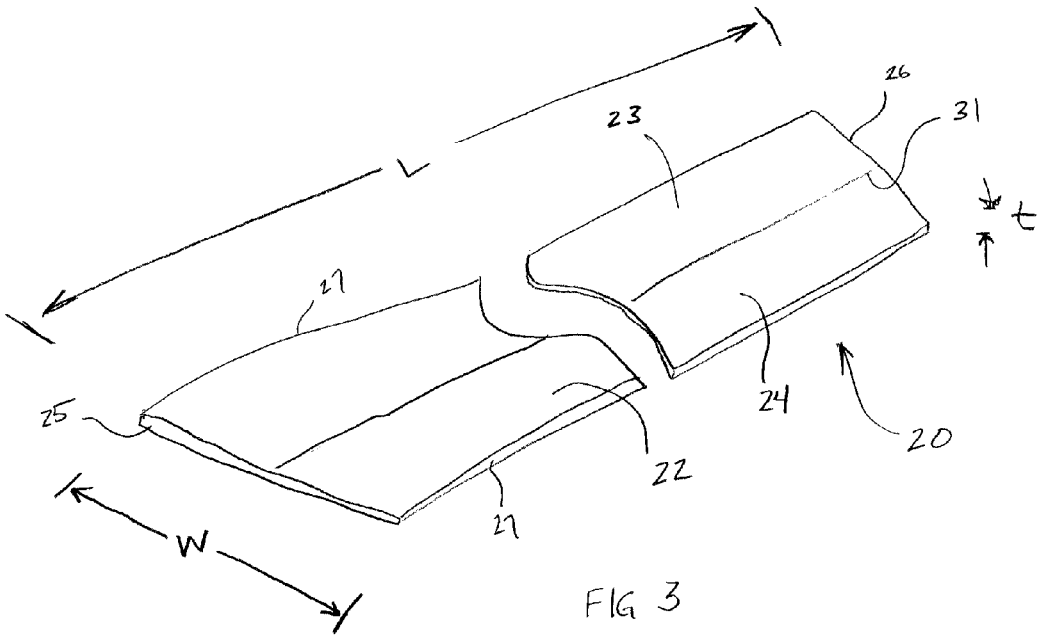
FIG. 3 is a perspective view of a tape.
Figure 4:
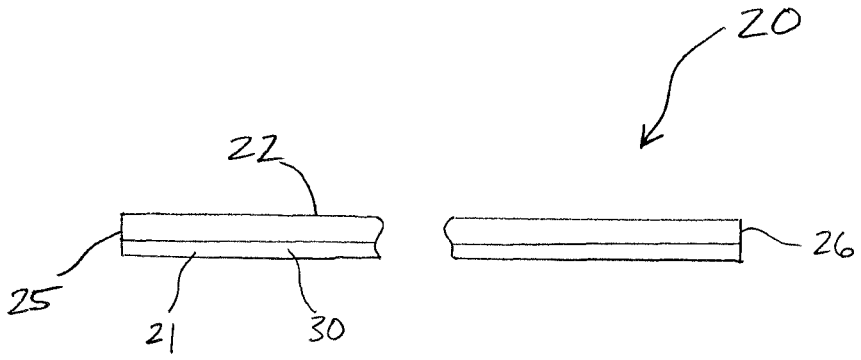
FIG. 4 is a side view of the tape of FIG. 3.

The tape 20 includes an elongated shape to extend across the beam 15. The tape 20 may extend across an entirety of the beam 15, or a limited portion. In one embodiment, the tape 20 extends across an entirety of the beam 15 and along sections of the sidewalls 14. FIGS. 3 and 4 illustrate the tape 20 that includes an elongated shape with a length L measured between opposing first and second ends 25, 26. The length may vary depending upon the head 11, and the amount of desired coverage across the beam 15. A width W is measured between opposing sides 27. The width 27 may also vary depending upon the desired use. A thickness t is measured between the first and second sides 21, 22.

The first side 21 is configured to face towards and be attached to the head 11. In one embodiment, the first side 21 includes an adhesive layer 30 that adheres to the head 11. The layer 30 may extend across an entirety of the side 21, or may extend across a limited section. The layer 30 may include a single type of adhesive, or two or more different adhesives.

In another embodiment, the first side 21 does not include an adhesive. Rather, a separate adhesive is placed on the first side 21 and/or the beam 15 for attachment of the tape 20.

The second side 22 is configured to face outwards from the head 11. The second side 22 includes the first section 23 that extends along a first portion of the length L, and the second section 24 that extends along an opposing portion of the length L. The first and second sections 23, 24 are in a non-overlapping arrangement on the second side 22. The first section 23 may extend inward from a side 27, and the second section 24 may extend inward from an opposing side 27. The first and second sections 23, 24 may abut together at an intermediate point of the width W, or may be spaced apart from one another along the intermediate portion of the tape 20.

The first section 23 includes a lower friction coefficient value than the second section 24. The first section 23 may also include a lower friction coefficient value than the beam 15 to which it is attached. This lower friction coefficient value facilitates sliding the head 11 along the ground during a game, such as is necessary when picking up a ball from the ground.

The second section 24 includes a higher friction coefficient value than the first section 23. The second section 24 may also include a higher friction coefficient value than the inner side of the beam 15 to which it is attached. The second section 24 is positioned to contact against the ball when it is positioned in the head 11. The high friction coefficient value provides for additional spin to be placed the ball when it is thrown which may provide an advantage of the user.

The widths of the various sections 23, 24 may vary. In some embodiments as illustrated in FIGS. 3 and 6, each section 23, 24 includes the same width across the tape 20. Other embodiments may include one of the sections 23, 24 with a greater width, such as FIG. 5 with the first section 23 being wider than the second section 24.

Figure 7:
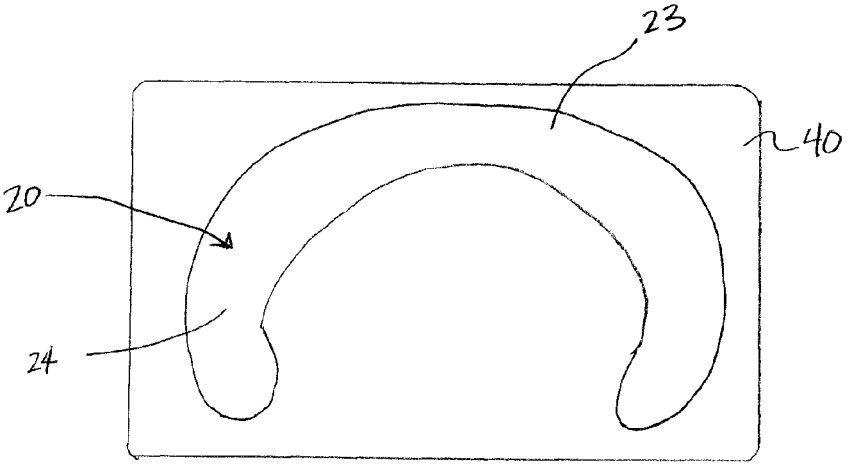
FIG. 7 is a top view of a sheet that includes a tape.

FIG. 7 includes an embodiment with the width W at the outer ends of the tape 20 being greater than along an intermediate section. This may facilitate contact with an attachment to the head 20 as the outer ends of the tape 20 may tend to become detached from the head 20 during use.

Indicia 31 may extend along the length L to visually indicate the position of the different sections 23, 24. The indicia 31 may include one or more lines that extend along the length L. The one or more lines may be continuous across the entire length, or may be discontinuous and extend across limited sections of the length L. The indicia 31 provides for the user to align the tape 20 with the head 11. In one embodiment, the indicia 31 is placed along the edge of the beam 15 such that the first section 23 is positioned along the outer side of the head 11 (that contacts against the ground) and the second section 24 is positioned along the inner side of the head 11 to contact the ball.

The tape 20 may also include other indicia such as logos of equipment manufacturers, teams, designs, etc. These may provide increase the aesthetics of the stick 9 in the eyes of the user and other competitors. The tape 20 may also include one or more sections with different colors. The different colors may provide a way for the user to align the different sections 23, 24 relative to the beam 15 and/or may increase the aesthetics.

The tape 20 may be configured in a roll that includes an elongated length. During application, the user unwinds the desired length of the tape 20, cuts the tape 20 from the roll, and then applies the tape 20 to the head 11. The tape 20 may also be attached to an enlarged sheet 40 as illustrated in FIG. 7. The sheet 40 includes a first top layer and a second bottom layer. The tape 20 forms a portion of the top layer with a backing forming the second bottom layer. In use, the user peels the tape 20 away from the bottom layer and the remainder of the top layer. The user than aligns the tape 20 with the head 11 and attaches it at the appropriate position.

Figure 5:
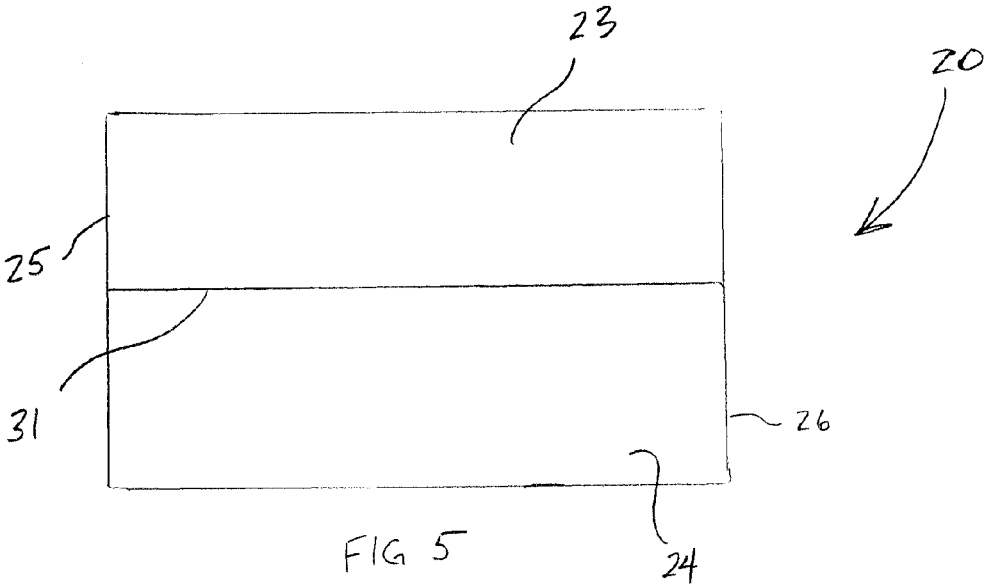
FIG. 5 is a top view of an outer side of a tape.
Figure 6:
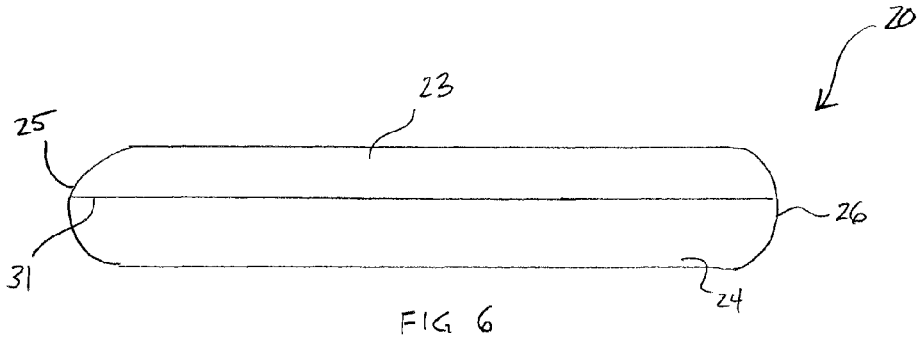
FIG. 6 is a top view of an outer side of a tape.

The tape 20 may include a substantially straight length as illustrated in FIGS. 3, 5, and 6. The tape 20 may also include a curved length as illustrated in FIG. 7. The curvature along the length may match that of the beam 15 and facilitate attachment.

In one embodiment, the tape 20 is aligned with the head such that the intersection between the sections 23, 24 aligns with the edge of the beam 15. This may include aligning the indicia with the edge. The tape 20 may also be aligned such that the section 23 with the lower friction coefficient value extends over the edge of the beam and onto the inner side of the beam 15. This may facilitate sliding of the head 11 along the ground as the user attempts to scoop the ball from the field.

The tape 20 may further be removed from the head 11 by the user. This may occur at various times, such as when the tape 20 becomes worn and when the user wants to changes the aesthetic appearance of the stick 10. Further, different tapes 20 may be used for different playing conditions. For example, a first tape with a first friction coefficient value may be used when playing on a field of natural grass and a second tape with a second friction coefficient value may be used when playing on a field of artificial turf.

Further, multiple layers of tape 20 may be attached to the head 11. A first layer is directly attached to the head 11, with additional layers being indirectly attached to the head 11 on top of the existing layer(s).

As described above, the tape 20 is useful for attaching to a head of a lacrosse stick. The tape 20 may also be used in other applications, including but not limited to hockey sticks and various other athletic equipment.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of preparing a lacrosse stick comprising:

aligning an elongated tape along a beam of a head of the lacrosse stick, the beam extending across a distal end of the head, the tape including a length measured between first and second ends and a width measured between opposing first and second lateral sides;

aligning a first width section of the tape along an outer side of the beam, the first width section extending inward from the first lateral side;

aligning a second width section of the tape along an inner side of the beam, the second width section extending inward from the second lateral side; and attaching the tape to the beam and limiting the placement of the second width section to the inner side of the beam;

the first and second width sections extending in a non-overlapping arrangement across the width of the tape and along the length of the tape;

the first width section including a lower friction coefficient value than the second width section and the outer side of the beam.

2. The method of claim 1, further comprising unwinding the tape from a roll and removing the tape from the roll prior to attaching the tape to the beam.

3. The method of claim 1, further comprising removing the tape from a backing on an enlarged sheet prior to attaching the tape to the beam.

4. The method of claim 1, further comprising contacting an adhesive on an underside of the tape against the beam and attaching the tape to the beam.

5. The method of claim 1, further comprising aligning indicia that extends along the length of the tape along an edge of the beam, the edge of the beam positioned between the inner and outer side of the beam.

6. The method of claim 5, wherein the indicia comprises a visible line positioned at an intersection of the first and second width sections of the tape.

7. The method of claim 1, further comprising preventing the second width section of the tape from being positioned on the outer side of the beam.

8. The method of claim 1, further comprising positioning the first width section across an edge of the beam between the inner and outer sides and along a portion of the inner side.

9. A method of preparing a lacrosse stick comprising:

attaching an elongated tape to a beam of a head of a lacrosse stick, the tape including a first section along a first portion of the width that has a lower friction coefficient and a second section along a second portion of the width that has a higher friction coefficient;

the first section of the tape attached over an outer side of the head of the lacrosse stick;

the second section of the tape attached over just an inner side of the head of the lacrosse stick without extending over the outer side.

10. The method of claim 9, wherein the first and second sections are in a non-overlapping arrangement across the width of the tape.

11. The method of claim 9, wherein the first width section includes a lower friction coefficient value than the outer side of the beam.

12. The method of claim 9, further comprising aligning an elongated indicia that extends along the length of the tape with an edge of the head formed between the inner and outer sides.

13. The method of claim 9, further comprising unwinding the tape from a roll and removing the tape from the roll prior to attaching the tape to the beam.

14. The method of claim 9, further comprising contacting an adhesive on an underside of the tape against the beam and attaching the tape to the beam.

15. The method of claim 9, further comprising positioning the first section across an edge of the beam between the inner and outer sides and along a portion of the inner side.

16. The method of claim 9, further comprising positioning a greater portion of the width of the tape along the outer side of the beam than along the inner side of the beam.

17. A method of preparing a lacrosse stick, the lacrosse stick including a frame that includes a beam and opposing sidewalls that form at least a portion of a pocket, the method comprising:

aligning a tape with the beam, the tape having an outer side and an inner side and a width measured between opposing first and second lateral sides, the outer side having a first portion of the width that extends inward from the first lateral side having a lower coefficient value than an outer side of the beam and a second portion of the width that extends inward from the second lateral side of the tape having a higher coefficient value than the first portion;

contacting the inner side of the tape against the beam and attaching the tape to the beam with the first portion exposed along the outer side of the beam and over an edge of the beam formed between the outer side and an inner side of the beam, and the second portion exposed along just the inner side of the beam;

the first and second portions extending in a non-overlapping arrangement across the width of the tape.

18. The method of claim 17, wherein the first portion includes a greater width than the second portion.

19. The method of claim 17, further comprising aligning indicia that extends along the length of the tape at an intersection of the first and second portions.

* * * * *